US005803429A

United States Patent [19]

Tsuzuki et al.

[11] Patent Number: 5,803,429

[45] Date of Patent: Sep. 8, 1998

[54] SOLENOID-OPERATED HYDRAULIC CONTROL VALVE FOR USE IN FUEL INJECTION SYSTEM FOR INTERNAL COMBUSTION ENGINE

[75] Inventors: Yoshihiro Tsuzuki; Kazuhide Watanabe, both of Nishio, Japan

[73] Assignee: Nippon Soken, Inc., Nishio, Japan

[21] Appl. No.: 601,579

[22] Filed: Feb. 14, 1996

[30] Foreign Application Priority Data

| | | | |
|---|---|---|---|
| Feb. 15, 1995 | [JP] | Japan | 7-026949 |
| Jul. 11, 1995 | [JP] | Japan | 7-174733 |
| Jul. 27, 1995 | [JP] | Japan | 7-191592 |

[51] Int. Cl.[6] ..... F16K 31/02

[52] U.S. Cl. ..... 251/30.04; 251/30.01

[58] Field of Search ..... 251/30.01, 30.04; 137/596.16, 596.14; 239/585.1

[56] References Cited

U.S. PATENT DOCUMENTS

| | | | |
|---|---|---|---|
| 5,143,291 | 9/1992 | Grinsteiner | 239/585.1 X |
| 5,464,156 | 11/1995 | Ricco et al. | 239/585.1 X |

FOREIGN PATENT DOCUMENTS

| | | |
|---|---|---|
| 63-150462 | 6/1988 | Japan . |
| 5-332220 | 12/1993 | Japan . |

OTHER PUBLICATIONS

"Fuel Injection Device" by T. Iwanaga; Journal of Nippondenso Technical Disclosure, Sep. 15, 1994; p. 53.

*Primary Examiner*—Kevin Lee
*Attorney, Agent, or Firm*—Cushman, Darby & Cushman IP Group of Pillsbury Madison & Sutro LLP

[57] ABSTRACT

A solenoid-operated hydraulic control valve is disclosed which may be employed in a fuel injection system for an internal combustion engine. The hydraulic control valve has a valve plunger which is drawn by a solenoid when turned on for selectively establishing and blocking fluid communication between an inlet and an outlet. A fluid chamber is formed to which fluid pressure is supplied from the inlet. The fluid pressure in the fluid chamber acts on the valve plunger in a direction opposite to that of the attracting force of the solenoid when turned on for compensating the attracting force produced by residual magnetism in the solenoid immediately after the solenoid is turned off.

15 Claims, 9 Drawing Sheets

SOLENOID-OPERATED HYDRAULIC CONTROL VALVE FOR USE IN FUEL INJECTION SYSTEM FOR INTERNAL COMBUSTION ENGINE

BACKGROUND OF THE INVENTION

1 Technical Field

The present invention relates generally to a solenoid-operated hydraulic control valve, and more particularly, to a solenoid-operated hydraulic control valve which may be employed in a fuel injection system for an internal combustion engine.

2 Background of the Related Art

FIG. 10 shows a conventional solenoid-operated hydraulic control valve 100 for use in a fuel injection system of an internal combustion engine which is taught in Japanese Patent First Publication No. 5-332220.

The hydraulic control valve 100 generally includes a holder 101 and a nozzle 102. The nozzle 102 is installed by a retainer 103 on the holder 101. A needle valve 105 is slidably disposed within the nozzle 102 and urged by a spring force exerted by a pressure spring 107 through a spring holder 106 and hydraulic pressure acting on an upper end of a command piston 108 to close a spray hole 126. The command piston 108 is greater in diameter than the needle valve 105 and slidably mounted in the holder 101 with a clearance of 2 to 3 $\mu$m.

An outer valve 111 is disposed in a guide hole 110 formed in the holder 101 with a clearance of 2 to 3 $\mu$m so as to be moved laterally, as viewed in the drawing, and urged by a spring 112 to the right into constant engagement with an outer valve seat 113. The outer valve 111 has formed in its left portion a central hole 115 into which an inner valve 117 is inserted with a clearance of 2 to 3 $\mu$m. The inner valve 117 has an inner valve seat 116 on which the hydraulic pressure acts to bias the inner valve 117 to the left. The outer valve 111 also has formed in its right portion a central hole into which a balance rod 118 is inserted with a clearance of 2 to 3 $\mu$m. The balance rod 118 has the same diameter as that of the inner valve seat 116 of the inner valve 117 and is urged by the hydraulic pressure to the right.

A high pressure inlet port 120 is formed in the holder 101, which communicates with the spray hole 126 through an annular groove 121, a fuel passage 122 formed in the holder 101, a fuel passage 123 formed in the nozzle 102, and a fuel reservoir 125. The annular groove 121 also communicates with a fuel passage 127 extending in a radial direction of the outer valve 111 and a fuel passage 128 extending in an axial direction of the outer valve 111. Thus, when the outer valve 111 is moved to the right so that the inner valve seat 116 leaves the fuel passage 128, the annular groove 121 communicates with a back pressure chamber 130 to which the upper end of the command piston 108 is exposed.

A spring chamber 131 in which a pressure spring 107 is disposed is formed in the holder 101 and communicates through a fluid passage 132 with a spring chamber 133 in which the spring 112 is disposed. The spring chamber 131 also communicates through a fluid passage 135 with a drain port 136. A lower pressure annular groove 137 formed in the outer valve 111 also communicates with the drain port 136 through a fluid passage 138 extending in the radial direction of the outer valve 111 and a lower pressure annular groove 140 formed in the holder 101.

In operation, when the solenoid 141 is energized, it will cause the outer valve 111 to be drawn to the left to establish fluid communication between the fluid passage 128 and the back pressure chamber 130. The back pressure chamber 130 then communicates with the drain port 136 so that the pressure therein is decreased. The needle valve 105 is, thus, moved upward by the hydraulic pressure in the fuel reservoir 125 communicating with the high pressure inlet port 120 to open the spray hole 126.

The above hydraulic control valve, however, encounters the following drawback which will not be objectionable when using an electrostrictive actuator instead of the solenoid 141, but are objectionable immediately after the solenoid 141 is deenergized. Specifically, when the solenoid 141 is deenergized, the hydraulic pressure acting on the outer valve 111 is canceled completely by the hydraulic pressure acting on the balance rod 118 since the inner valve seat 116 is the same in diameter as the balance rod 118. Thus, only the spring force of the spring 112 acts on the outer valve 111 in order to close the valve. However, since the magnetism (i.e., residual magnetism) remains in the solenoid 141 after being deenergized, the outer valve 111 is drawn to the solenoid 141 until the residual magnetism disappears, thereby resulting in delay in an valve opening operation. This makes it difficult to fine adjust the amount of fuel discharged from the spray hole 126. This problem is also encountered in a two-port type hydraulic control valve as well as a three-port type control valve such as that discussed above.

SUMMARY OF THE INVENTION

It is therefore a principal object of the present invention to avoid the disadvantages of the prior art.

It is another object of the present invention to provide a solenoid-operated hydraulic control valve which is designed to eliminate delay in response of a valve operation caused by the residual magnetism in a solenoid immediately after being turned off.

According to one aspect of the present invention, there is provided a solenoid-operated fluid control valve apparatus which comprises: (1) a valve housing having formed therein a fluid inlet, a fluid outlet, and a fluid passage communicating the fluid inlet to the fluid outlet; (2) a first valve member movable along a given traveling path defined within the valve housing, the first valve member having formed therein a fluid chamber, the fluid chamber having a chamber inlet communicating with the fluid inlet and a chamber outlet communicating with the fluid outlet; (3) a solenoid producing an attracting force acting on the first valve member to move the first valve member along the given traveling path; (4) a second valve member disposed within the valve housing, and having a pressure-energized surface which communicates with the fluid chamber formed In the first valve member so as to selectively open and close the chamber outlet of the fluid chamber according to movement of the first valve member by the attracting force of the solenoid; and (5) a balance rod disposed within the valve housing, the balance rod having a pressure-energized surface communicating with the fluid chamber formed in the first valve member. Fluid pressure in the fluid chamber produces a thrust acting on the first valve member to move the first valve member along the given traveling path in a direction opposite to that of the attracting force produced by the solenoid.

In the preferred mode of the invention, the solenoid-operated fluid control valve apparatus is a three-port type hydraulic control valve.

A spring is disposed within the valve housing so as to produce a spring force urging the first valve member in the direction opposite to that of the attracting force produced by the solenoid.

According to another aspect of the present invention, there is provided a solenoid-operated fluid control valve apparatus which comprises: (1) a valve housing having formed therein a fluid inlet, a fluid outlet, and a fluid passage communicating the fluid inlet to the fluid outlet; (2) a valve member movable along a given traveling path defined in the valve housing, the valve member having a chamber and a valve head, the valve head selectively establishing and blocking fluid communication between the fluid inlet and the fluid outlet according to movement of the valve member along the given traveling path, the chamber having a pressure-energized surface having formed therein a fluid port communicating with the fluid inlet; (3) a solenoid producing an attracting force acting on the valve member to move the valve member along the given traveling path; (4) a balance rod disposed within the chamber of the valve member and having a pressure-energized surface; and (5) a fluid chamber defined by the pressure-energized surface of the chamber of the valve member and the pressure-energized surface of the balance rod so that fluid pressure supplied to the fluid chamber from the fluid port urges the valve member along the given traveling path in a direction opposite to that of the attracting force of the solenoid.

In the preferred mode of the invention, an enclosed accumulator chamber is defined within the fluid chamber when the pressure-energized surface of the balance rod closes the fluid port of the fluid chamber according to movement of the valve member by the attracting force of the solenoid. The enclosed accumulator chamber is so designed that the fluid pressure held in the enclosed accumulator chamber acts on the valve member so as to urge the valve member along the given traveling path in the direction opposite to that of the attracting force of the solenoid. Preferably, the solenoid-operated fluid control valve apparatus is a two-port type hydraulic control valve.

According to a further aspect of the present invention, there is provided a solenoid-operated fluid control valve apparatus which comprises: (1) a valve housing having formed therein a chamber, a fluid inlet, a fluid outlet, and a fluid passage communicating the fluid inlet to the fluid outlet, the chamber communicating with the fluid inlet; (2) a valve member movable along a given traveling path defined within the valve housing in a first direction and a second direction opposite the first direction for establishing and blocking fluid communication between the fluid inlet and the fluid outlet, the valve member having an armature which is disposed within the chamber formed in the valve housing and which has a pressure-energized surface on which fluid pressure in the chamber acts to urge the valve member in the first direction; (3) a spring disposed within the valve housing for urging the valve member in the first direction; (4) a solenoid producing an attracting force acting on the armature of the valve member for moving the valve member in the second direction; and (5) a pressure regulating means for regulating the fluid pressure in the chamber formed in the valve member to maintain the fluid pressure at a given level.

In the preferred mode of the invention, the chamber formed in the valve housing has a drain and the pressure regulating means regulates the fluid pressure discharged through the drain. Preferably, the solenoid-operated fluid control valve apparatus is a two-port type hydraulic control valve. Also, the pressure regulating means is a poppet valve or an orifice.

A second valve member and a balance rod are provided. The valve member has formed therein a chamber communicating with the fluid inlet. The second valve member and the balance rod are disposed opposite to each other through the chamber along the given traveling path.

According to a still further aspect of the present invention, there is provided a solenoid-operated fluid control valve apparatus which comprises: (1) a valve housing having formed therein a fluid inlet, a fluid outlet, and a fluid passage communicating the fluid inlet to the fluid outlet; (2) a valve member movable along a given traveling path defined in the valve housing in a first direction and a second direction opposite the first direction, the valve member having a valve head and a chamber, the valve head providing a pressure-energized surface exposed to the fluid inlet, the valve head selectively establishing and blocking fluid communication between the fluid inlet and the fluid outlet, (3) a fluid port communicating the chamber with the fluid inlet; (4) a solenoid producing an attracting force acting on the valve member to move the valve member in the first direction along the given traveling path; (4) a balance rod having a pressure energized surface, the balance rod being disposed within the hole of the valve member so as to have the pressure-energized surface of the balance rod and the chamber define a fluid chamber, the pressure-energized surface of the balance rod being greater in area than the pressure-energized surface of the valve head so that fluid pressure in the fluid chamber produces a thrust acting on the valve member greater than the force exerted on the valve head by the fluid pressure in the fluid inlet to move the valve member along the given traveling path in the second direction opposite the first direction; and (5) a spring disposed within the valve housing for urging the valve member in the second direction along the given traveling path.

In the preferred mode of the invention, the solenoid-operated fluid control valve apparatus is a two-port type hydraulic control valve.

A needle valve is provided which is movable along a given needle valve traveling path for selectively opening and closing a valve hole. A command piston has a surface exposed to a back pressure chamber to move the needle valve along the given needle valve traveling path according to variation in fluid pressure in the back pressure chamber. The valve head of the valve member selectively establishes and blocks the fluid communication between the fluid inlet and the fluid outlet to achieve the variation in fluid pressure in the back pressure chamber.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
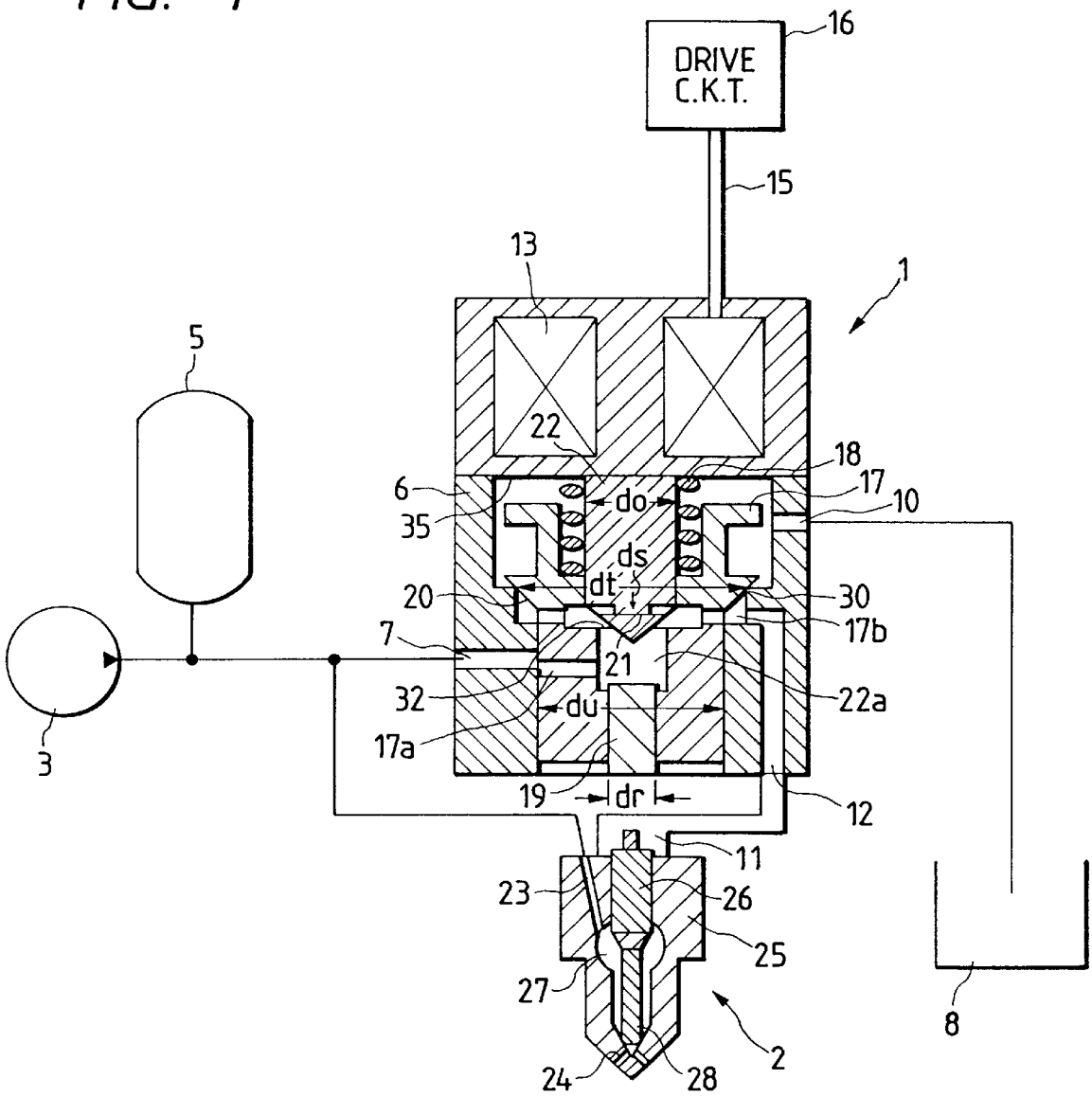
FIG. 1 is a cross sectional view which shows a solenoid-operated hydraulic control valve employed in a fuel injection system for an internal combustion engine.

Referring now to the drawings, particularly to FIG. 1, there is shown a three-port type hydraulic control valve 1 according to the present invention which is mounted in an accumulator fuel injection device for an internal combustion engine.

The accumulator fuel injection device includes the three-port type hydraulic control valve 1 and a fuel injector 2. Fuel compressed by a fuel injection pump 3 is accumulated in a reservoir 5 under 2000 kgf/cm$^2$ and then supplied to the fuel injector 2 mounted in the engine. The hydraulic control valve 1 has a high-pressure port 7, a drain port 10, and a control port 12 formed in a holder 6 (i.e., a housing). The high-pressure port 7 communicates with the reservoir 5. The drain port 10 communicates with a fuel tank 8. The control port 12 communicates with a back pressure chamber 11 of the fuel injector 2. Mounted on the holder 6 is a solenoid 13 which is connected to a drive circuit 16 through a lead wire 15.

Within the holder 6, a valve plug 17 (hereinafter, referred to as an outer valve) having formed therein communication ports 17*a* and 17*b* is disposed. The outer valve 17 is supported slidably along a valve rod 22 (hereinafter, referred to as an inner valve) and is urged by a coil spring 18 to bring a valve head 20 into constant engagement with a valve seat 30 of the holder 6 when the solenoid 13 is deenergized. The inner valve 22 is inserted into a hole formed in the outer valve 17 and is urged upward, as viewed in the drawing, by a high pressure fuel introduced into a chamber 22*a* formed in the outer valve 17 through the ports 7 and 17*a* from the reservoir 5 into constant engagement with the bottom of a solenoid casing 35. A balance rod 19 is inserted into an end portion of the outer valve 17 in alignment with the inner valve 22 and urged downward, as viewed in the drawing, by the high pressure fuel introduced into the chamber 22*a*.

When the solenoid 13 is energized to attract the outer valve 17 upward, it will cause a fluid outlet port 32 of the chamber 22*a* to be closed by a valve head 21 (i.e., a pressure-energized surface) of the inner valve 22 to define a working chamber. The high pressure fuel introduced into the working chamber 22*a* then acts on the valve seat 21 of the inner valve 22 and an end surface (i.e., a pressure-energized surface) of the balance rod 19. The difference in cross sectional area on a plane perpendicular to a traveling path of the outer valve 17 between pressure-energized surfaces (i.e., the valve head 21 and the end surface) of the outer valve 17 and the inner valve 22 produces a thrust to urge the outer valve 17 downward, as will be discussed later in detail.

The fuel injector 2 includes a nozzle 25 and a needle valve 26. The nozzle 25 has formed therein a fuel port 23, spray holes 24, and a fuel reservoir 27. The needle valve 26 is disposed in the nozzle 25 slidably in vertical directions, as viewed in the drawing. The fuel port 23 communicates with the reservoir 5 to supply the high pressure fuel to the fuel reservoir 27. The high pressure fuel in the reservoir 5 is also supplied through the ports 7, 17*a*, 17*b*, and 12 to the back pressure chamber 11 of the fuel injector 2 and then urges the needle valve 26 downward. When the solenoid 13 is deenergized, the needle valve 26 is seated on a nozzle seat 28 to block the spray holes 24.

Figure 2:
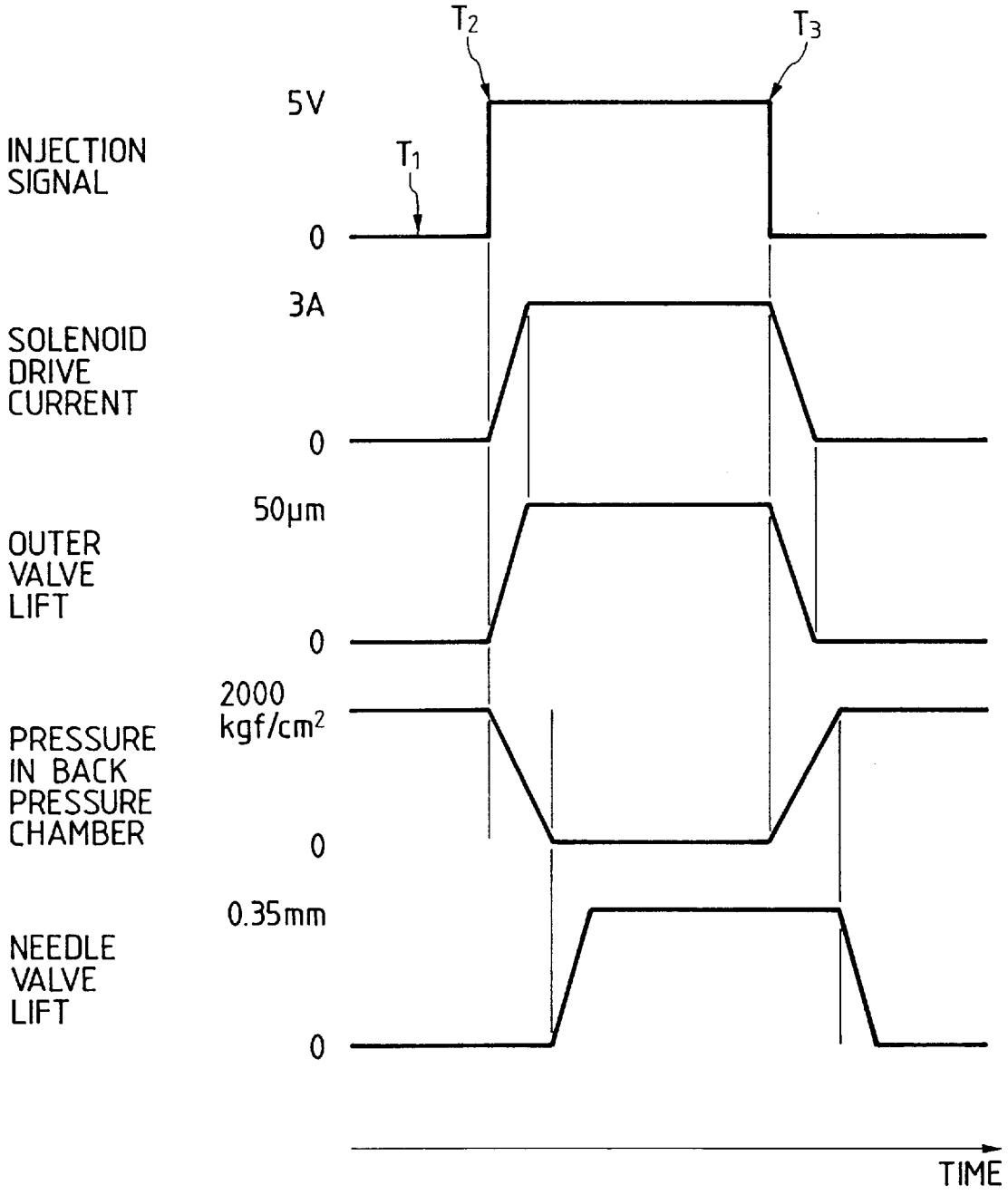
FIG. 2 is a time chart which shows operations of the system shown in FIG. 1 according to a given fuel injection scheme.

In operation, when the solenoid 13 is turned off (at a time T1 in a time chart of FIG. 2), the hydraulic control valve 1 is in an inoperative condition, as shown in FIG. 1. The fuel stored under a pressure of 2000 kgf/cm$^2$ within the reservoir 5 is supplied through the high pressure port 7, the communication ports 17*a* and 17*b*, and the control port 12 to the back pressure chamber 11 of the nozzle 25 and also supplied around the spray holes 24 through the fuel port 23 and the fuel reservoir 27. The fuel pressure in the back pressure chamber 11 acts on the needle valve 26 to urge it downward into engagement with the nozzle seat 28, blocking the spray holes 24.

The then downforce $F_0$ acting on the outer valve 17 is expressed by the following relation:

$F_0$=(the force of the spring 18)+(the pressure of the fuel)×{(the diameter *do* of the inner valve member 22)$^2$−(a diameter *dr* of the balance rod 19)$^2$−(a diameter *dt* of the valve head 20)$^2$+(a guide diameter *du* of the outer valve 17)$^2$}×π/4

For instance, $F_0=5+2000\times\{(0.4)^2-(0.295)^2-(0.843)^2+(0.8)^2\}\times\pi/4=8.65$ kgf When a current (e.g., 3A) is supplied through the lead wire 15 from the drive circuit 16 to the solenoid 13 at a time T2 for spraying the fuel, it will cause the outer valve 17 to be attracted upward by 50 μm against the spring force of the spring 18 so that the fluid outlet port 32 is closed by the valve seat 21 of the inner valve 22, thereby blocking the fluid communication between the control port 12 and the high pressure port 7, while the control port 12 communicates with the drain port 10. Thus, the pressure in the back pressure chamber 11 is decreased so that the fuel pressure in the fuel reservoir 27 urges the needle valve 26 upward by 0.35 mm out of engagement with the nozzle seat 28. This will cause the spray holes 24 to be opened so that the high pressure fuel in the fuel reservoir 27 is discharged outward through the spray holes 24.

During the discharge of the fuel, the chamber 22*a*, as discussed above, is closed by the valve seat 21 of the inner valve 22 to serve as the working chamber so that the difference in cross sectional area between the pressure-energized surfaces (i.e., the valve seat 21 and the end surface 37) of the outer valve 17 and the inner valve 22 produces a hydraulic thrust urging the outer valve 17 downward. This hydraulic thrust is, however, smaller than an attracting force of the solenoid 13, and, thus, the fluid outlet port 32 of the outer valve 17 remains closed by the valve seat 21 of the inner valve 22.

When the solenoid 13 is deenergized at a time T3 for stopping the discharge of the fuel through the spray holes 24, it will cause the residual magnetism to be produced for a short time so that the attracting force $F_r$ acts on the outer valve 17.

The then downforce $F_1$ acting on the outer valve 17 is expressed by the following relation:

$F_1$=(the force of the spring 18)+(the pressure of the fuel)×{(the diameter *ds* of a portion of the valve seat 21 exposed to the chamber 22*a*)$^2$−(the diameter *dr* of the balance rod 19)$^2$}×π/4−(the attracting force $F_r$ created by the residual magnetism)

Figure 9:
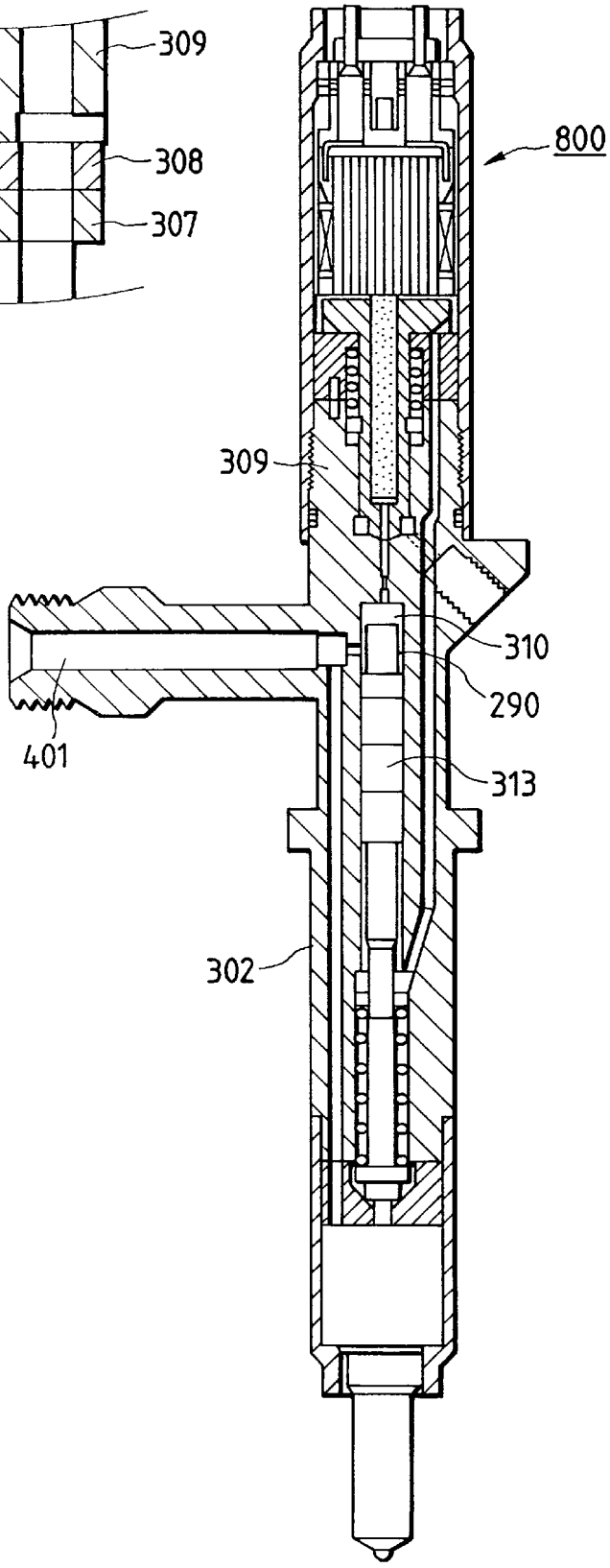
FIG. 9 is a cross sectional view which shows a modified form of the solenoid-operated hydraulic control valve shown in FIG. 7, according to the seventh embodiment of the invention.
Figure 10:
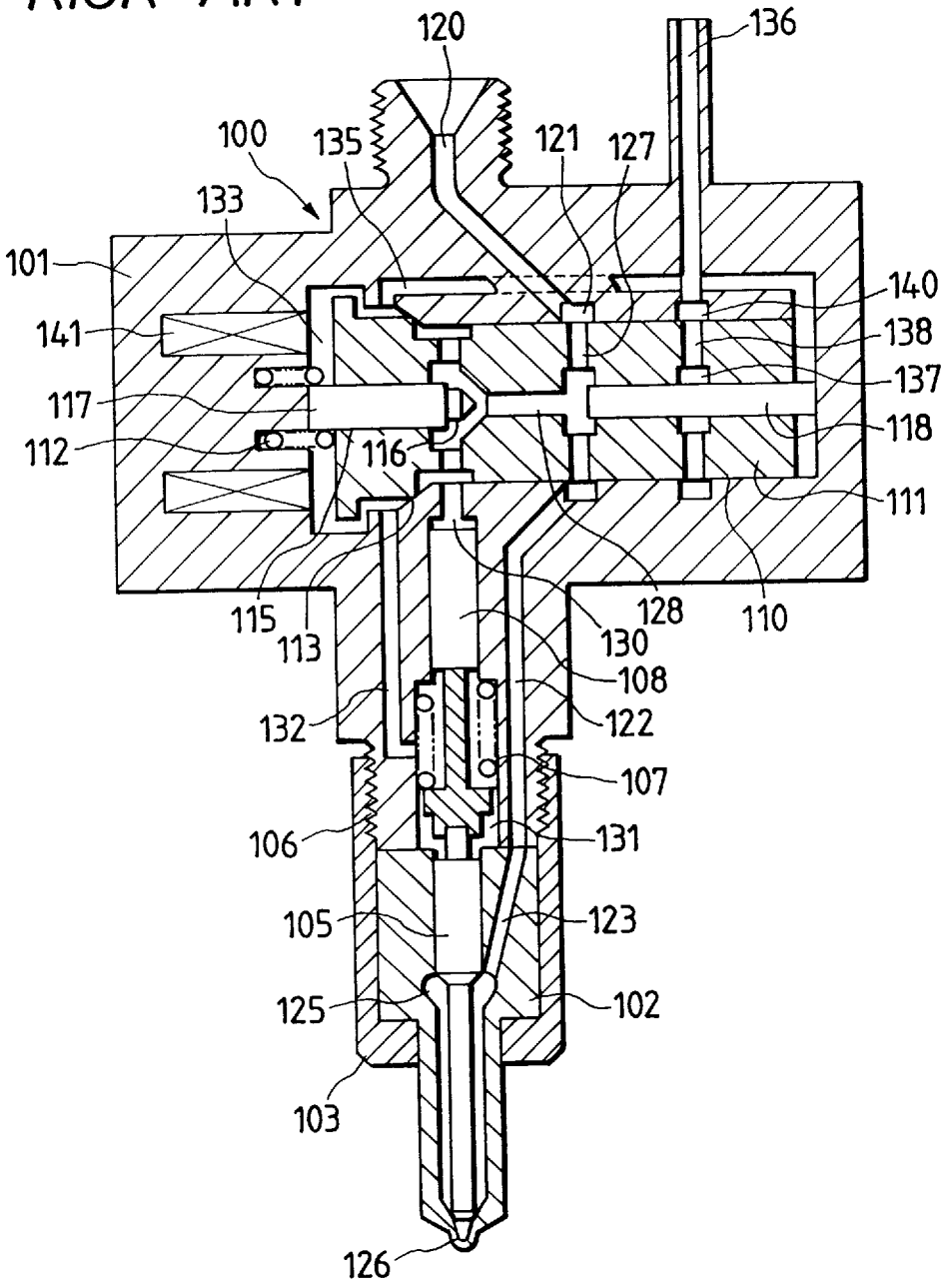
FIG. 10 PRIOR ART
FIG. 10 is a cross sectional view which shows a conventional solenoid-operated hydraulic control valve mounted on a fuel injector.

For instance, $F_1=5+2000\times\{(0.3)^2-(0.295)^2\}\times\pi/4-F_r\approx(5+4.6\text{ kgf})-F_r$ The feature of this embodiment is, as discussed above, that the diameter dr of the balance rod 19 is set smaller than the diameter ds of the portion of the valve seat 21 exposed to the chamber 22*a,* in other words, the pressure-energized surface of the inner valve 22 is set greater than the pressure-energized surface of the balance rod 19 so that the hydraulic pressure in the chamber 22*a* when closed may produce a thrust to urge the outer valve 17 in a direction opposite to that of the attracting force of the solenoid 13. In the conventional hydraulic control valve, as shown in FIG. 9, when the needle valve 105 is in the valve closing position, a force urging the outer valve member 111 to the right is only the spring force of the spring 112. Thus, when the attracting force produced by the residual magnetism of the solenoid 141 acting on the outer valve member 111 is greater than the spring force of the spring 112, it holds the outer valve member 111 until the residual magnetism disappears. This results in a great delay in response of a valve closing operation of the hydraulic control valve.

In this embodiment, the diameter ds (e.g., 3 mm) of the valve seat 21 of the inner valve 22 is, as already mentioned, greater than the diameter (e.g., 2.95 mm) dr of the balance rod 19 so that the difference in cross sectional area between the pressure-energized surfaces of the inner valve 22 and the balance rod 19 may produce a thrust of, for example, 4.6 kgf acting on the outer valve 17. Upon turning off the solenoid valve 13, the thrust urges the outer valve 17 downward with aid of the spring force of the spring 18 so that the fluid outlet port 32 of the outer valve 17 is moved out of engagement with the valve seat 21 of the plug 22. Therefore, when the needle valve 26 is moved downward to close the spray holes 24, the downforce $F_1$ acting on the outer valve 17 will be 9.6 kgf which is the sum of the spring force 5 kg of the spring 18 and the thrust 4.6 kgf. Even if the force Fr produced by the residual magnetism of the solenoid 13 draws the outer valve 17 upward, the downforce $F_1$ overcomes the force Fr so that the outer valve 17 is moved quickly in the downward direction, thereby decreasing the delay in response caused by the residual magnetism of the solenoid 13. This allows a decrease in amount of fuel sprayed from the spray holes 24 to be adjusted with high accuracy. When the outer valve 17 is moved out of engagement with the valve seat 21 of the inner valve 22, the downforce produced in the working chamber 22*a* and the force Fr produced by the residual magnetism of the solenoid 13 acting on the outer valve 17 disappear so that only the spring force of the spring 18 acts on the outer valve 17 to move it downward smoothly. Thus, the high pressure fuel in the reservoir 5 flows through the high pressure port 7, the communication ports 17*a* and 17*b,* and the control port 12 into the back pressure chamber 11 to urge the needle valve 26 downward to close the spray holes 24.

The spring 18 may be omitted by further increasing the difference in cross sectional area between the pressure-energized surfaces of the outer valve 17 and the inner valve 22. This allows component parts of the hydraulic pressure control valve 1 to be decreased, thereby resulting in the total manufacturing costs of the valve being decreased. Further, it is advisable that the diameter of the balance rod 19 be selected so as to minimize the hydraulic force acting on the outer valve 17 within the working chamber 22*a* to the extent that it cancels the force Fr produced by the residual magnetism of the solenoid 13. This achieves a reduced size for an overall valve structure.

Figure 3:
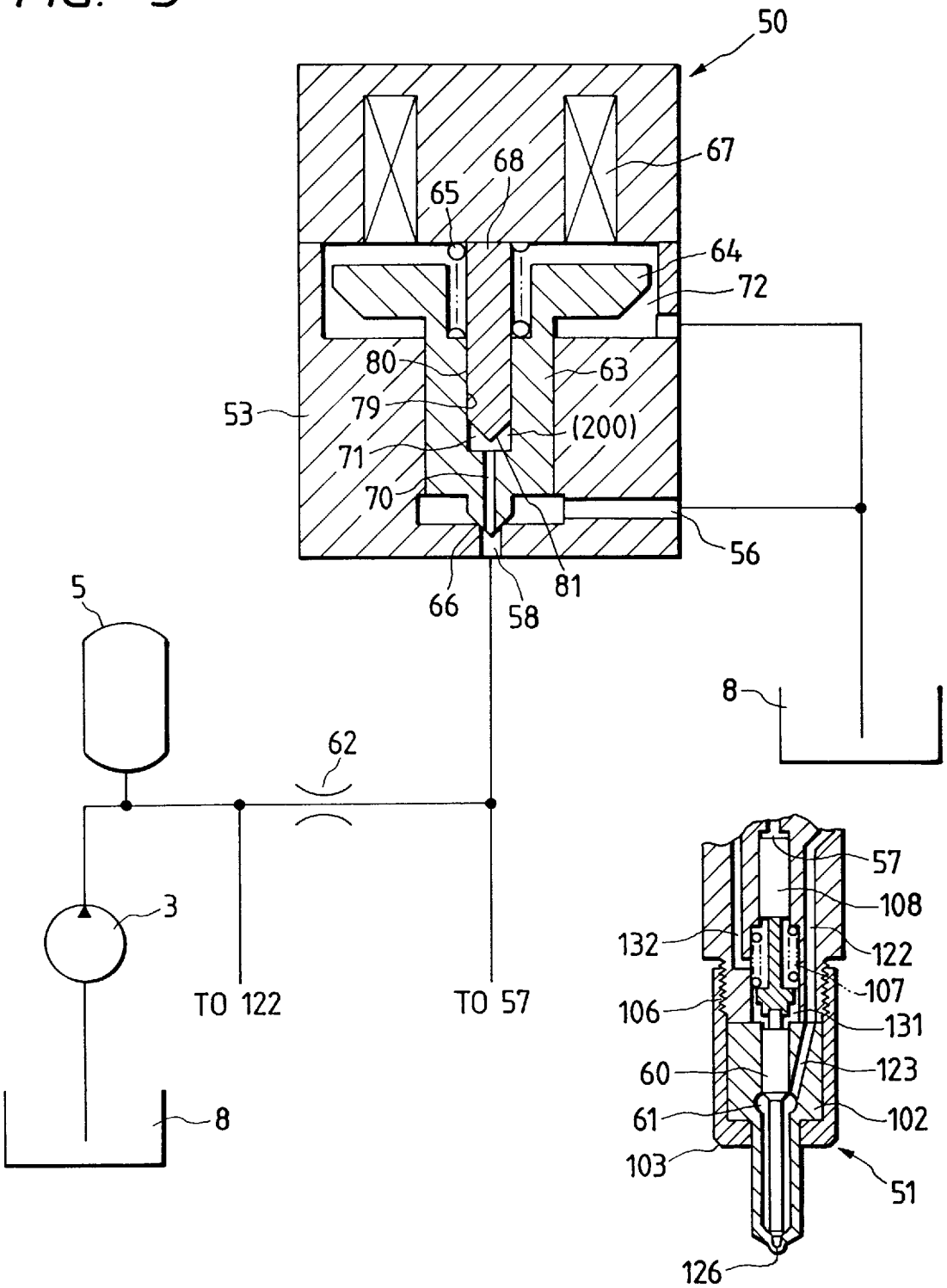
FIG. 3 is a cross sectional view which shows a solenoid-operated hydraulic control valve according to the second embodiment of the invention.

Referring to FIG. 3, there is shown a solenoid-operated two-port type hydraulic control valve 50 according to the second embodiment of the invention which is mounted in an accumulator fuel injection device for an internal combustion engine.

The accumulator fuel injection device includes the two-port type hydraulic control valve 50 and a fuel injector 51 like the prior art shown in FIG. 9. Fuel compressed by a fuel injection pump 3 is accumulated in a reservoir 5 and then supplied to the fuel injector 51 mounted in the engine.

A body or housing 53 of the hydraulic control valve 50 has formed therein a drain port 56 communicating with a fuel tank 8 and a control port 58 communicating with a back pressure chamber 57 of the fuel injector 51. The high pressure fuel compressed by the fuel injection pump 3 and stored in the reservoir 5 is supplied through a fuel port 122 to a fuel reservoir 61 formed around a needle valve 60 of the fuel injector 51 and also supplied to the back pressure chamber 57 and a control port 58 through a restrictor 62. The high pressure in the back pressure chamber 57 urges the needle valve 60 downward, as viewed in the drawing, to close a spray hole 126.

Within the housing 53 of the hydraulic control valve 50, a valve plunger 63 is disposed to be slidable in vertical directions along a balance rod 68. The balance rod 68 is disposed within a central hole 79 formed in the valve plunger 63. A coil spring 65 is disposed between the bottom of a solenoid housing and a bore formed above the central hole 79 of the valve plunger 63 to urge the valve plunger 63 downward, thereby bringing a valve head 66 of a needle valve formed on an end of the valve plunger 63 into constant engagement with the control port 58.

The valve plunger 63 has formed on its end an armature disc 64 which is disposed within an armature chamber 72 formed in the housing 53 and faces a solenoid 67 mounted above the housing 53.

The high pressure fuel introduced into the control port 58 is supplied through a communication port 70 into a lower chamber 71 defined within the central hole 79 by the balance rod 68 to urge the balance rod 68 upward into constant engagement with the bottom of the solenoid housing.

The balance rod 68 includes a guide portion 80 and a tapered end surface 81 (i.e., a valve seat) forming a pressure-energized surface on which fluid pressure in the lower chamber 71 acts. The hydraulic control valve 50 may be mounted on the fuel injector 51 coaxially therewith or placed away from the fuel injector 51 using a connection pipe.

The hydraulic control valve 50 shown in FIG. 3 is in an inoperative position. If a downward direction, as viewed in the drawing, is positive, the force $F_0$ acting on the valve plunger 63 is given by the following equation:

$$F_0=\frac{\pi}{4}\,(d_{RG}^2-d_S^2)\times P_0+F_S \tag{1}$$

where $d_s$ is the diameter of a portion of the valve head 66 exposed to the control port 58, $d_{RG}$ is the diameter of the guide portion 80 (i.e., the diameter of the lower chamber 71), $P_0$ is the pressure in the control port 58, and $F_S$ is the spring force of the spring 65.

In operation, when the solenoid 67 is energized, it will cause the valve plunger 63 to be drawn upward so that the valve head 66 is moved out of engagement with the control port 58. The control port 58 then communicates with the drain port 56, decreasing the pressure of the back pressure chamber 57. The needle valve 60 is then urged upward by the fuel pressure in the fuel reservoir 61 to open the spray hole 126 for discharging the fuel under high pressure.

When the valve plunger 63 is moved upward against the spring force of the spring 65, the valve head 81 blocks the communication port 70 of the valve plunger 63 to define an accumulator chamber 200 within the lower chamber 71 enclosed by the valve head 81 and the bottom of the lower chamber 71.

When the solenoid 67 is deenergized, it will cause the residual magnetism to be produced for a short time so that the attracting force $F_r$ acts on the valve plunger 63.

The then downforce $F_C$ acting on the valve plunger 63 is expressed by the following equation:

$$F_C = \frac{\pi}{4}\,(d_{RG}^2 - d_{RS}^2) \times P_A + F_S - F_r \tag{2}$$

where $d_{RG}$ is the diameter of the guide portion 80 of the balance rod 68 (i.e., the diameter of the lower chamber 71), $d_{RS}$ is a diameter of a portion of the valve head 81 exposed to the communication port 70 (i.e., the diameter of the communication port 71), $P_A$ is the pressure in the accumulator chamber 200, and $F_S$ is the spring force of the spring 65.

The pressure in the accumulator chamber 200 defined by the valve seat 81 within the lower chamber 71 is maintained equal to the pressure in the control port 58 (equal to the pressure in the reservoir 5) produced when the valve head 66 engages the control port 58 after the valve head 66 is moved out of engagement with the control port 58. Therefore, a valve closing force enough to overcome the attracting force $F_r$ produced by the residual magnetism of the solenoid 67 and to urge the valve plunger 63 downward may be created by selecting a combination of the diameters $d_{RS}$, $d_{RG}$, and $d_S$.

If $d_{RG}$=3 mm, $d_{RS}$=2.95 mm, $F_S$=5 kgf, and $P_A$=2000 kgf/cm$^2$, then the downforce $F_C$ acting on the valve plunger 63 is $$\begin{aligned} F_C &= \frac{\pi}{4} \times (0.3^2 - 0.295^2) \times 2000 + 5 - F_r \\ &\approx 4.6 + 5 - F_r \end{aligned}$$

Therefore, a downforce of 4.6 kgf is produced by the pressure in the accumulator chamber 200 so that a pressure of 9.6 kgf that is the sum of the 4.6 kgf and 5 kgf of the spring force of the spring 65 acts on the valve plunger 63 against the attracting force $F_r$ produced by the residual magnetism of the solenoid 67.

The fuel injector 51 shown in FIG. 3 has a command piston 108, but the present invention is not limited to this structure. The benefits of the present invention is obtained even if the command piston is omitted.

Figure 4:
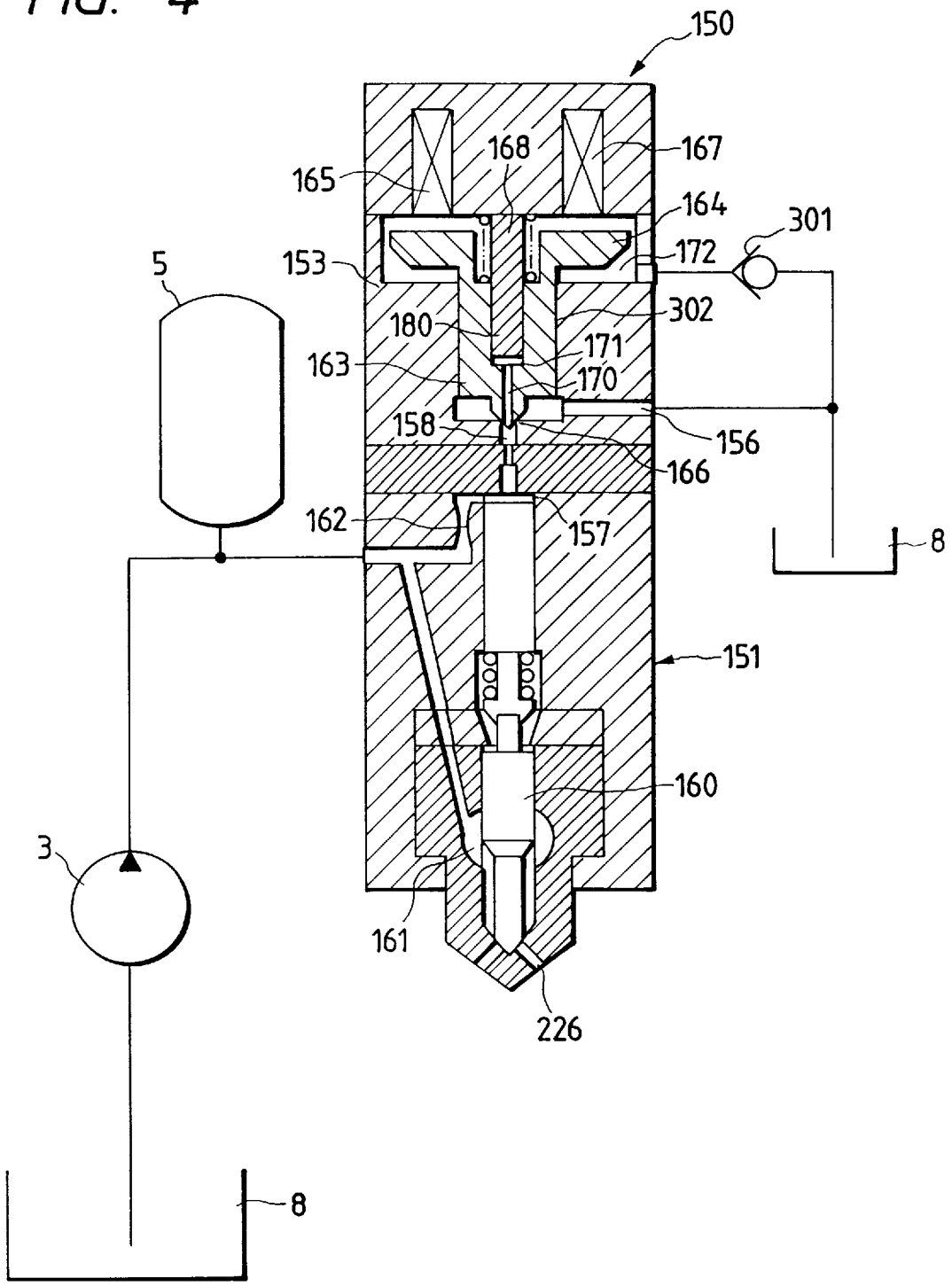
FIG. 4 is a cross sectional view which shows a solenoid-operated hydraulic control valve according to the third embodiment of the invention.

FIG. 4 shows a two-port type hydraulic control valve 150 according to the third embodiment of the invention which is mounted in an accumulator fuel injection device for an internal combustion engine.

Fuel compressed by a fuel injection pump 3 is accumulated in a reservoir 5 and then supplied to a fuel injector 151 secured coaxially with the pressure control valve 150. A housing 153 of the hydraulic control valve 150 has formed therein a drain port 156 communicating with the fuel tank 8 and a control port 158 communicating with a back pressure chamber 157. The high pressure fuel compressed by the fuel injection pump 3 and stored in the reservoir 5 is supplied to a fuel reservoir 161 formed around a needle valve 160 and also supplied to the back pressure chamber 157 and a control port 158 through a restrictor 162. The high pressure in the back pressure chamber 157 urges the needle valve 160 downward, as viewed in the drawing, to close a spray hole 226.

Within the housing 153 of the hydraulic control valve 150, a valve plunger 163 is disposed slidably in vertical directions along a guide portion 180 of a balance rod 168. The balance rod 168 is inserted slidably into a central hole formed in the valve plunger 163. A coil spring 165 is disposed between the bottom of a solenoid housing and a bore formed above the central hole of the valve plunger 163 to urge the valve plunger 163 downward, thereby bringing a valve head 166 of a needle valve (i.e., a valve head) formed on an end of the valve plunger 163 into constant engagement with the control port 158.

The valve plunger 163 has formed on its end an armature disc 164 which is disposed within an armature chamber 172 formed in the housing 153 and which faces a solenoid 167 mounted on the housing 153.

The high pressure fuel entering the control port 158 is supplied through a communication port 170 into a lower chamber 171 defined within the central hole by a flat end surface of the balance rod 168 to urge the balance rod 168 upward into constant engagement with the bottom of the solenoid housing.

The high pressure fuel in the lower chamber 171 flows into the armature chamber 172 through a clearance of about 2 to 3 $\mu$m between the balance rod 168 and the valve plunger 163. The armature chamber 172 communicates with the fuel tank 8 and the drain port 156 through a pressure regulator 301.

The hydraulic control valve 150 shown in FIG. 4 is in an inoperative position. If a downward direction, as viewed in the drawing, is positive, the force $F_1$ acting on the valve plunger 163 is given by the following equation:

$$F_1 = \frac{\pi}{4}\,(d_{RG}^2 - d_{VS}^2) \times P_f + \frac{\pi}{4}\,(d_{VG}^2 - d_{RG}^2) \times P_r + F_S \tag{3}$$

where $d_{RG}$ is the diameter of the guide portion 180 of the balance rod 168 (i.e., the diameter of the lower chamber 171), $d_{VS}$ is a seat diameter of the valve head 166 (i.e., a diameter of a portion of the valve head 166 exposed to the control port 158, $P_f$ is a fuel injection pressure, $d_{VG}$ is the diameter of the guide portion 302 of the valve plunger 163, $P_r$ is a residual pressure in the armature chamber 172, and $F_S$ is a spring force of the spring 165.

In operation, when the solenoid 167 is energized, it will cause the valve plunger 163 to be drawn upward so that the valve head 166 is moved out of engagement with the control port 158. The control port 158 then communicates with the drain port 156, decreasing the pressure of the back pressure chamber 157. The needle valve 160 is then urged upward by the fuel pressure in the fuel reservoir 161 to open the spray hole 226 for discharging the fuel under high pressure.

The disengagement of the valve head 166 from the control port 158 causes the pressure in the control port 158 to be reduced down to about atmospheric pressure. Therefore, if a downward direction, as viewed in the drawing, is positive, a valve closing force $F_2$ acting on the valve plunger 163 is given by the following equation:

$$F_2 = \frac{\pi}{4}\ (d_{VG}^2 - d_{RG}^2) \times P_r + F_S \quad (4)$$

It will be noted that the above equation (4) corresponds to the equation (3) from which the first term is omitted.

If $d_{RG}$=3 mm, $d_{VG}$=6.5 mm, $P_r$=10 kg/cm$^2$, $F_S$=8 kgf, and $d_{VS}$=3.14 mm, then $F_1$=9.3 kgf (if $P_f$=200 kgf/cm$^2$), or $F_1$=2.7 kgf (if $P_f$=1200 kgf/cm$^2$), and $F_2$=10.6 kgf.

Therefore, even when the solenoid 167 is deenergized to stop spraying the fuel, and the attracting force $F_r$ produced by the residual magnetism acts on the valve plunger 163 in a direction opposite to that of $F_2$ (=10.6 kgf), the valve closing force $F_2$ is increased by 2.6 kgf as compared with when only the spring force $F_S$ (=8 kgf) of the spring 165 acts on the valve plunger 163, thereby allowing the valve plunger 163 to close the control port 158 quickly. Thus, the delay in response of a valve closing operation of the hydraulic control valve 150 caused by the residual magnetism of the solenoid 167 is greatly decreased.

Further, the third embodiment has the advantage that by setting the magnitude of force acting on the valve plunger 163 to open the control port 158 provided by in the first term of the equation (3) to a suitable value, as exemplified above, an optimum valve closing force acting on the valve plunger 163 is produced at all times, and a more strong valve opening force is also produced. Thus, the response in a valve closing operation is improved, and the valve plunger 163 may be moved to open the control port 158 with a less attracting force provided by the solenoid 167, resulting in greatly improved controllability of the valve 150.

In FIG. 4, the pressure regulator 301 is illustrated as being mounted outside the hydraulic control valve 150, but it may alternatively be built in the hydraulic control valve 150.

The residual pressure $P_r$ in the armature chamber 172 is defined as 10 kg/cm$_2$ in the equation (4), but it may be changed according to a variation in the fuel injection pressure $P_f$ if a fuel injection pump capable of changing the fuel injection pressure $P_f$ is used Further, the pressure regulator 301 is illustrated as being a poppet valve, but an orifice may alternatively be used for producing the residual pressure within the armature chamber 172.

Figure 5:
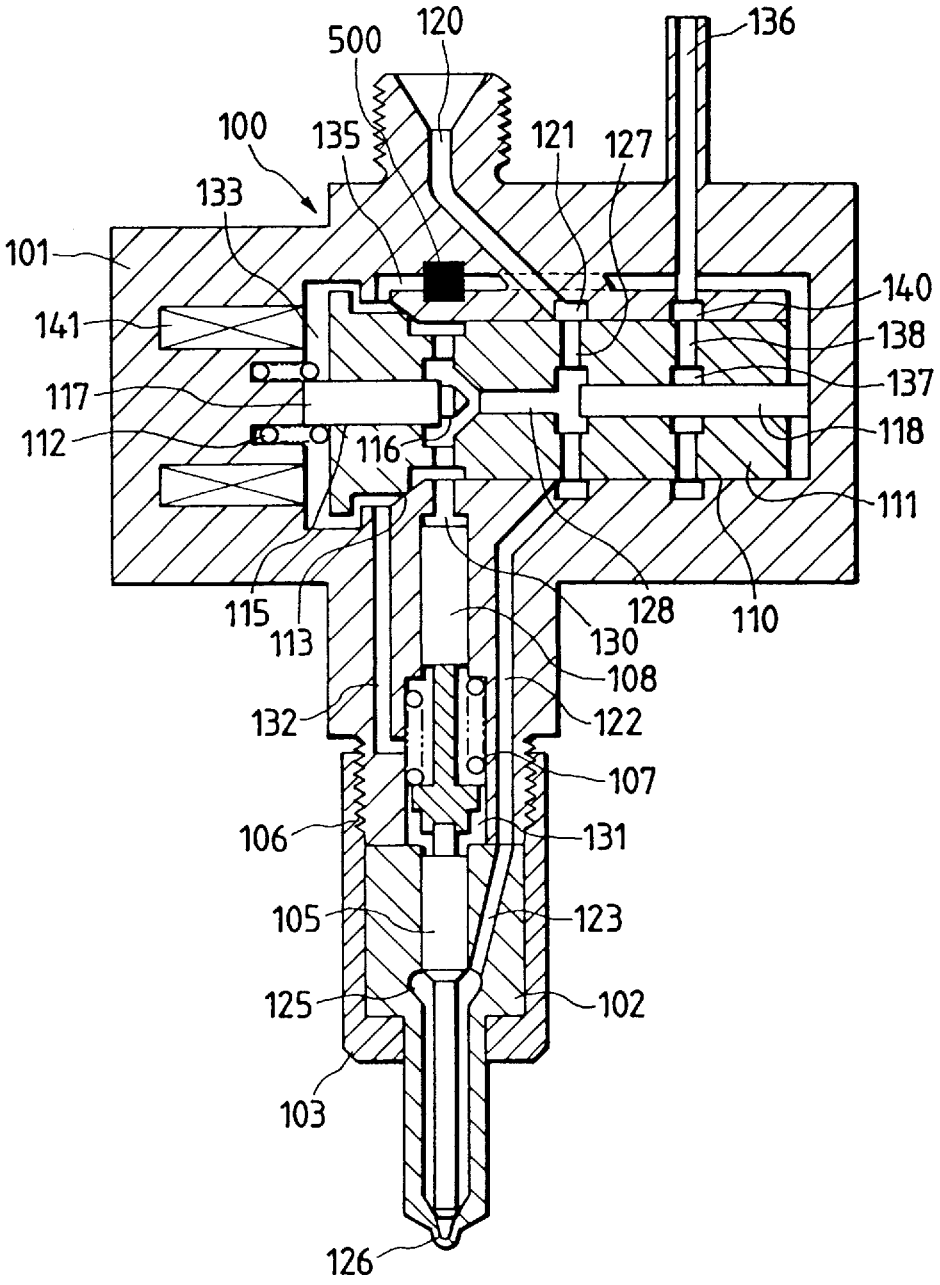
FIG. 5 is a cross sectional view which shows a solenoid-operated hydraulic control valve according to the fourth embodiment of the invention.

FIG. 5 shows a fourth embodiment of the invention which is a combination of a pressure regulator 500 and the conventional hydraulic control valve shown in FIG. 9. The same reference numbers as employed in FIG. 9 refer to the same parts, and explanation thereof in detail will be omitted here.

The pressure regulator 500 which corresponds to the pressure regulator 301 in the third embodiment is disposed in a fluid passage extending from the armature chamber 133 in which an armature is disposed to a drain for producing a residual pressure within the armature chamber 133 to assist the spring 112 in urging the outer valve member 111.

Figure 6:
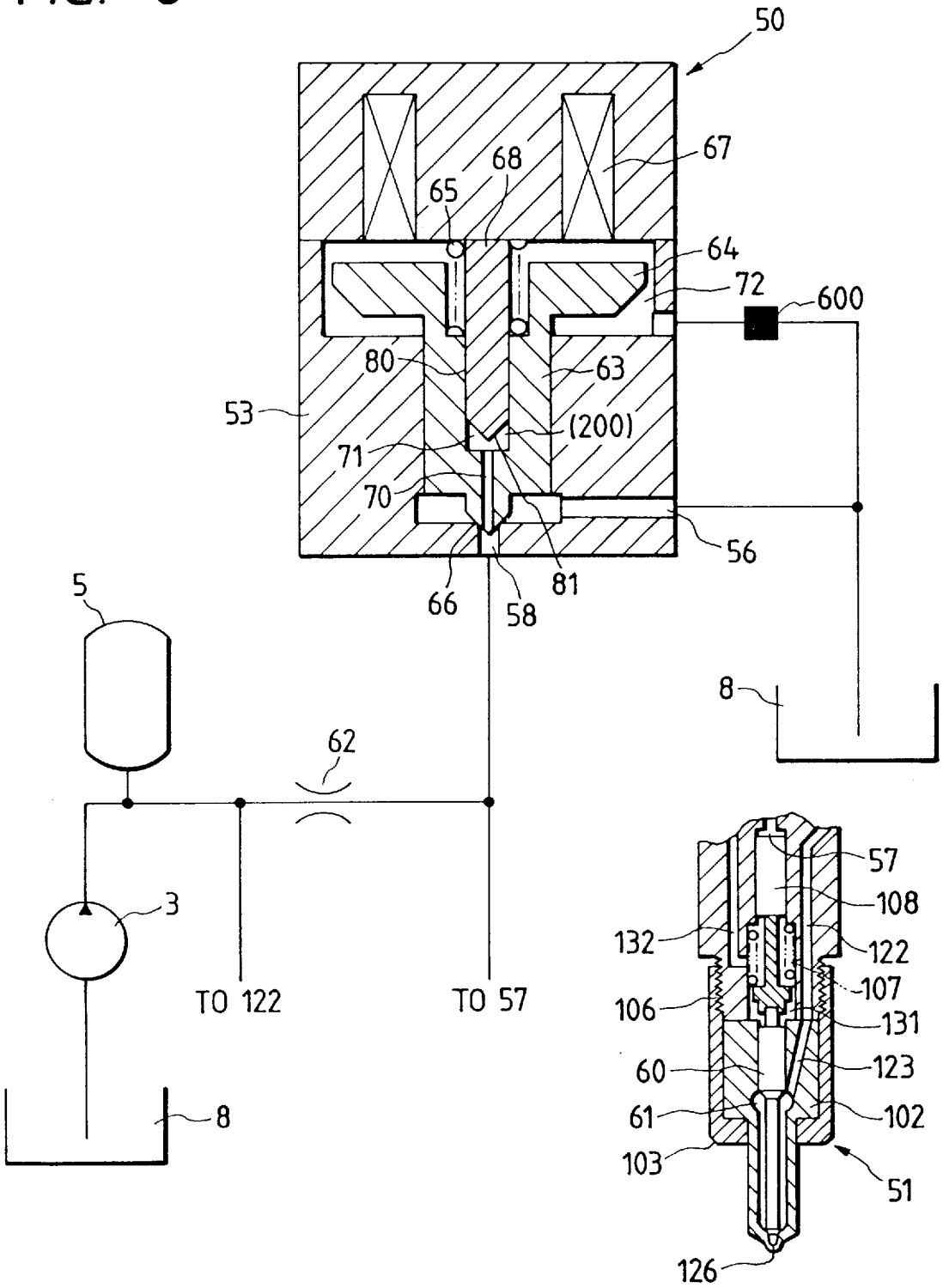
FIG. 6 is a cross sectional view which shows a solenoid-operated hydraulic control valve according to the fifth embodiment of the invention.

FIG. 6 shows a fifth embodiment of the invention which is different from the second embodiment shown in FIG. 3 only in that a pressure regulator 600 which corresponds to the pressure regulator 301 in the third embodiment shown in FIG. 4 is disposed between the armature chamber 72 and the fuel tank 8. The pressure regulator 600 includes a poppet valve or a restrictor such as an orifice. Other arrangements and operations are the same, and explanation thereof in detail will be omitted here.

The force acting on the valve plunger 63 when the hydraulic control valve 50 is closed to stop spraying the fuel may be expressed according to the above equation (3). The force $F_3$ acting on the valve plunger 63 when the hydraulic control valve 50 is opened to spray the fuel is given by an equation which is a combination of $$\frac{\pi}{4}\ (d_{RG}^2 - d_{RS}^2) \times P_A + F_S$$

that corresponds to the equation (2) from which $F_r$ is omitted and $$\frac{\pi}{4}\ (d_{VG}^2 - d_{RG}^2) \times P_r$$

that is the first term of the equation (4).

Therefore, If $d_{RG}$=3 mm, $d_{VG}$=6.5 mm, $d_{VS}$=3.14 mm, $F_S$=8 kgf, and $P_f$=1200 kgf/cm$^2$, then $F_1$=2.78 kgf, and $$\begin{aligned} F_3 &= \frac{\pi}{4}\ (d_{RG}^2 - d_{RS}^2) \times P_A + F_S + \frac{\pi}{4}\ (d_{VG}^2 - d_{RG}^2) \times P_r \\ &= 2.76 + 8 + 2.6 \\ &\approx 13.3 \text{ kgf} \end{aligned}$$

It will be appreciated that the great valve opening force $F_3$ acts on the valve plunger 63 when the hydraulic control valve 50 is opened.

Figure 7:
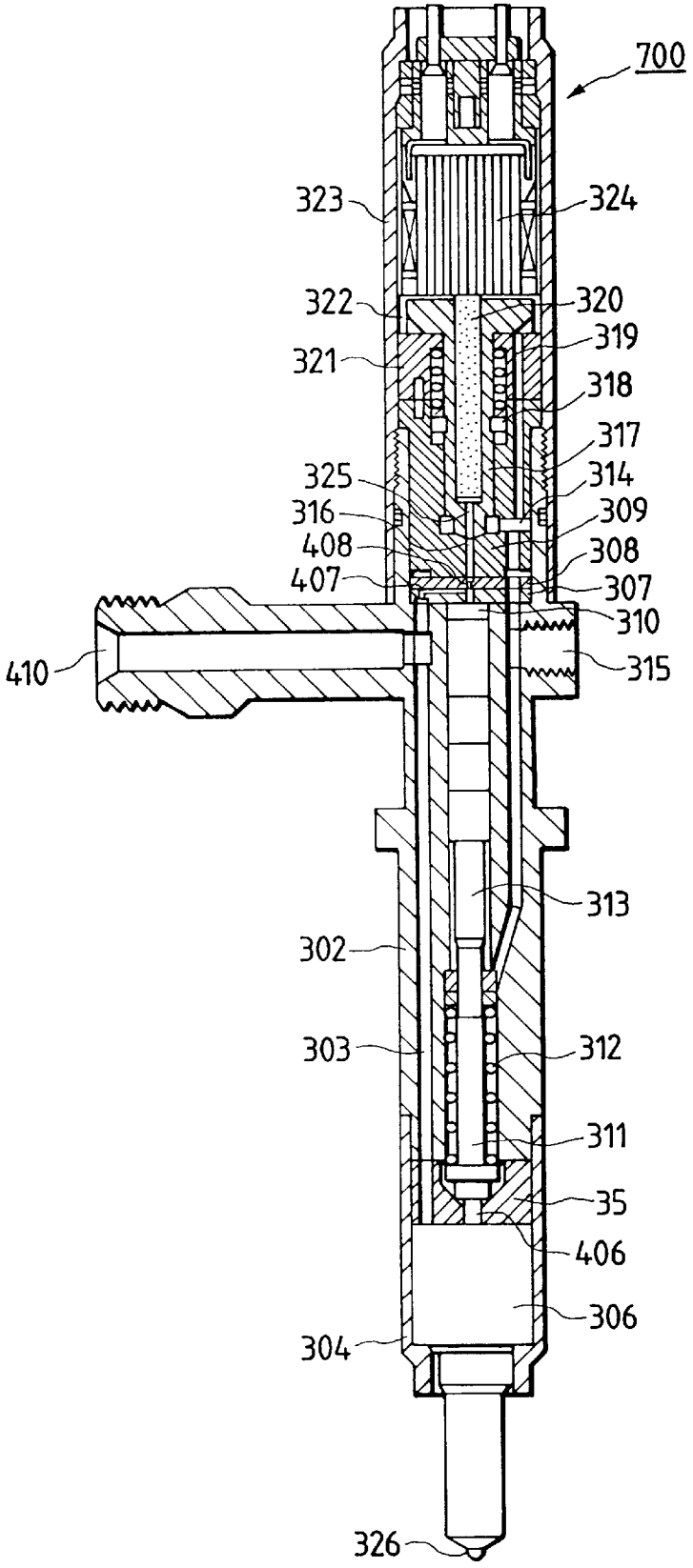
FIG. 7 is a cross sectional view which shows a solenoid-operated hydraulic control valve integrally formed with a fuel injector according to the sixth embodiment of the invention.

FIG. 7 shows a balance type two-port hydraulic control valve 700 using a balance rod 32 according to the sixth embodiment of the invention which is mounted in an accumulator fuel injection device for an internal combustion engine.

Figure 8:
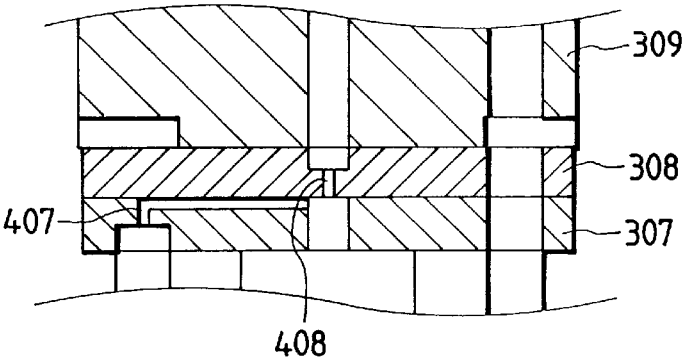
FIG. 8 is an enlarged partly cross sectional view of FIG. 7.

The high pressure fuel is supplied from a high pressure source (not shown) consisting of a fuel injection pump and a reservoir to an inlet 401 and then directed through a fluid passage 303 formed in a body 302 and a distance piece 305 secured in the body 302 using a retaining nut 304 to a fuel reservoir of a nozzle 306 having a structure well known in the art. A piece 307 having formed therein an orifice 407, as clearly shown in FIG. 8, and a piece 308 having formed therein an orifice 408 are secured on the body 302 by a valve body 309. Within the body 302, a spring support 311 is disposed on a pin 406 on a needle valve in the nozzle 6 and urged downward by a pressure spring 312. A command piston 313 is disposed within the body 302 in alignment with the spring support 311 and supported slidably along a center line of the valve 700. A back pressure chamber 310 is formed on the command piston 313 within the body 302 to which the high pressure fuel is supplied from the inlet 401 through the orifice 407.

The valve body 309 has formed therein a control port 316 and a drain port 314. The control port 316 communicates with the back pressure chamber 310 through the orifice 408. The drain port 314 communicates with a drain 315 formed in the body 302. Within the valve body 309, a valve plunger 317 is slidably disposed along the center line of the valve 700 and urged downward by a valve spring 319 disposed within a bore formed in an upper portion 321 of the valve body 309 into engagement with the control port 316. The balance rod 320 is disposed within a central hole formed in the valve plunger 317 and urged upward by the high pressure fuel supplied through a fluid passage 325. Secured on the valve plunger 317 is a solenoid 324 which is retained on the valve plunger 317 through a spacer 322 within a body holder 323 (i.e., housing).

In operation, when the solenoid 324 is energized to discharge the fuel through a spray hole 326, it will cause the valve plunger 317 to be drawn to the solenoid 324 against the spring force of the valve spring 319 to leave its seat, thereby establishing fluid communication between the control port 316 and the drain port 314. The fluid pressure in the control port 316 is then reduced since the amount of the fuel supplied from the orifice 407 is smaller than the amount of the fuel flowing to the drain port 314. The hydraulic pressure within the fuel reservoir of the nozzle 306 acts on a pressure-energized surface of the needle valve to urge the command piston 313 upward to open the spray hole 326.

The feature of the hydraulic control valve 700 of this embodiment is that the valve spring 319 urging the valve plunger 317 in the valve closing direction is disposed outside the solenoid 324. This allows a pole area (i.e., magnetic attraction) of the solenoid 324 and a spring force acting on the valve plunger 317 in the valve opening direction to be adjusted independently, thereby achieving quick valve closing response and a stable valve operation. Further, as compared with conventional hydraulic control valves, the volume of space occupied by the valve spring 319 may be decreased if the pole area of the solenoid 324 is the same as those of the conventional hydraulic control valves, thereby allowing the overall size of the valve 700 to be reduced greatly.

FIG. 9 shows a balance type two-port hydraulic control valve 800 according to a seventh embodiment of the invention which is different form the sixth embodiment in that a clearance 290 serving as an orifice establishing fluid communication between the back pressure chamber 310 and the fuel inlet 401 is formed between an inner wall of the body 302 and a peripheral surface of the command piston 313, and the valve body 309 and the body 302 are of a one-piece structure which eliminates the need for the pieces 307 and 308. Other arrangements and operation are identical, and explanation thereof in detail will be omitted here.

The above arrangements eliminate the need for a sealing portion, as formed in the sixth embodiment between an upper surface of the body 302 and a lower surface of the piece 307, thereby resulting in ease of manufacturing and decrease in component parts. Further, fluid leakage is avoided which is caused by failure in sealing the body 302 and the piece 307.

While the present invention has been disclosed in terms of the preferred embodiment in order to facilitate a better understanding thereof, it should be appreciated that the invention an be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A solenoid-operated fluid control valve apparatus comprising:

a valve housing having formed therein a fluid inlet and a fluid outlet communicating with the fluid inlet;

a first valve member movable along a traveling path defined within said valve housing, said first valve member having formed therein a fluid chamber, the fluid chamber having a chamber inlet communicating with said fluid inlet and a chamber outlet communicating with said fluid outlet;

a solenoid producing an attracting force acting on said first valve member to move said first valve member along said traveling path; and a second valve member disposed within said valve housing, the second valve member having a surface communicating with said fluid chamber formed in said first valve member, said second valve member being constructed and arranged to close said chamber outlet of said fluid chamber as said first valve member is moved along the traveling path by the attracting force of said solenoid;

said surface of said second valve member, said fluid chamber, and said first valve member being constructed and arranged such that fluid pressure in said fluid chamber exerts force on said first valve member when said chamber outlet is closed and moves said first valve member along the traveling path in a direction opposite to that of the attracting force produced by said solenoid.

2. A solenoid-operated fluid control valve apparatus as set forth in claim 1, wherein said solenoid-operated fluid control valve apparatus is a three-port type hydraulic control valve.

3. A solenoid-operated fluid control valve apparatus as set forth in claim 1, further comprising a spring disposed within said valve housing, said spring being constructed and arranged to bias said first valve member in the direction opposite to that of the attracting force produced by said solenoid.

4. A solenoid-operated fluid control valve apparatus comprising:

a valve housing having formed therein a fluid inlet and a fluid outlet communicating with the fluid inlet;

a valve member movable along a traveling path defined within said valve housing, said valve member having a valve head, the valve head being constructed and arranged to selectively allow and prevent fluid communication between said fluid inlet and said fluid outlet as said valve member is moved along the traveling path, a chamber defined in said valve member having an interior surface;

a fluid port communicating said chamber with said fluid inlet;

a solenoid producing an attracting force acting on said valve member to move said valve member along the traveling path;

a balance rod disposed within the chamber of said valve member, said balance rod having an end surface communicating with said chamber; and a fluid chamber defined by said interior surface of said chamber of said valve member and the end surface of said balance rod, said fluid chamber being constructed and arranged such that fluid pressure supplied to said fluid chamber from the fluid port moves said valve member along said traveling path in a direction opposite to that of the attracting force of said solenoid.

5. A solenoid-operated fluid control valve apparatus as set forth in claim 4, wherein said balance rod is constructed and arranged to close said fluid port as said valve member is moved along the traveling path bv the attracting force of said solenoid, said apparatus further comprising:

an enclosed accumulator chamber defined within said fluid chamber when said end surface of said balance rod closes said fluid port of said fluid chamber, said enclosed accumulator chamber being constructed and arranged such that the fluid pressure in said enclosed accumulator chamber exerts force on said valve member and moves said valve member along said traveling path in the direction opposite to that of the attracting force of said solenoid.

6. A solenoid-operated fluid control valve apparatus as set forth in claim 4, wherein said solenoid-operated fluid control valve apparatus is a two-port type hydraulic control valve.

7. A solenoid-operated fluid control valve apparatus comprising:

a valve housing having formed therein a chamber, a fluid inlet and a fluid outlet communicating with the fluid inlet, said chamber communicating with the fluid inlet;

a valve member movable along a traveling path defined within said valve housing in a first direction and a second direction opposite the first direction, said valve member being constructed and arranged to selectively allow and prevent fluid communication between said fluid inlet and said fluid outlet as said valve member is moved along said traveling path, said valve member having an armature disposed within said chamber formed in said valve housing, said armature having an armature surface on which fluid pressure in said chamber exerts force to to move said valve member in the first direction along said traveling path;

a spring disposed within said valve housing, said spring being constructed and arranged to exert force on said valve member and move said valve member in the first direction along said traveling path;

a solenoid producing an attracting force acting on the armature of said valve member for moving said valve member in the second direction; and a pressure regulator constructed and arranged such that said pressure regulator regulates the fluid pressure in the chamber formed in said valve housing to maintain the fluid pressure therein at a given level.

8. A solenoid-operated fluid control valve apparatus as set forth in claim 7, wherein said chamber formed in said valve housing has a drain, and said pressure regulator regulates the fluid pressure discharged through the drain.

9. A solenoid-operated fluid control valve apparatus as set forth in claim 7, wherein said solenoid-operated fluid control valve apparatus is a two-port type hydraulic control valve.

10. A solenoid-operated fluid control valve apparatus as set forth in claim 7, wherein said pressure regulator is a poppet valve.

11. A solenoid-operated fluid control valve apparatus as set forth in claim 7, wherein said pressure regulator is an orifice.

12. A solenoid-operated fluid control valve apparatus as set forth in claim 7, further comprising a second valve member and a balance rod, wherein said valve member has formed therein a fluid chamber communicating with said fluid inlet, said second valve member and said balance rod communicate with said fluid chamber and said fluid chamber is constructed and arranged such that fluid pressure in said fluid chamber exerts force on said balance rod and the second valve member and moves said valve member along said traveling path in the first direction.

13. A solenoid-operated fluid control valve apparatus comprising:

a valve housing having formed therein a fluid inlet and a fluid outlet communicating with the fluid inlet;

a valve member movable along a traveling path in a first direction and a second direction opposite the first direction, said valve member having a valve head, and a chamber, said valve head providing a surface communicating with said fluid inlet, the valve head being constructed and arranged to selectively allow and prevent fluid communication between said fluid inlet and said fluid outlet, a fluid port formed in said valve head communicating said chamber with said fluid inlet;

a solenoid producing an attracting force acting on said valve member to move said valve member in the first direction along the traveling path;

a balance rod having an end surface, said balance rod being disposed within said chamber of said valve member such that said end surface of said balance rod and said chamber of said valve member define a fluid chamber, said end surface of said balance rod being greater in area than said surface of said valve head communicating with the fluid inlet such that fluid pressure in the fluid chamber exerts a force on said valve member greater than a force exerted on said surface of said valve head by fluid pressure in said fluid inlet and moves said valve member along the traveling path in the second direction; and a spring disposed within said valve housing, said spring being constructed and arranged said valve member in the second direction along the traveling path.

14. A solenoid-operated fluid control valve apparatus as set forth in claim 13, wherein said solenoid-operated fluid control valve apparatus is a two-port type hydraulic control valve.

15. A solenoid-operated fluid control valve apparatus as set forth in claim 13, further comprising a needle valve movable along a needle valve traveling path to selectively open and close a valve hole and a command piston having a surface exposed to a back pressure chamber, said command piston being constructed and arranged to move said needle valve along said needle valve traveling path according to changes in fluid pressure in said back pressure chamber, wherein said valve head of said valve member is constructed and arranged to selectively allow and prevent the fluid communication between said fluid inlet and said fluid outlet to achieve the variation in fluid pressure in said back pressure chamber.

* * * * *